US009728308B2

(12) United States Patent
Springborn et al.

(10) Patent No.: US 9,728,308 B2
(45) Date of Patent: Aug. 8, 2017

(54) SURGE ARRESTER COMPRISING TRACTION ELEMENTS MAINTAINED BY LOOPS

(71) Applicant: SIEMENS AKTIENGESELLSCHAFT, Munich (DE)

(72) Inventors: Dirk Springborn, Berlin (DE); Markus Sulitze, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 382 days.

(21) Appl. No.: 14/417,210

(22) PCT Filed: Jun. 12, 2013

(86) PCT No.: PCT/EP2013/062138

§ 371 (c)(1),
(2) Date: Jan. 26, 2015

(87) PCT Pub. No.: WO2014/016042

PCT Pub. Date: Jan. 30, 2014

(65) Prior Publication Data

US 2015/0213925 A1 Jul. 30, 2015

(30) Foreign Application Priority Data

Jul. 26, 2012 (EP) ..... 12177997

(51) Int. Cl.

| | |
|---|---|
| ***H01C 7/12*** | (2006.01) |
| ***H01C 7/18*** | (2006.01) |
| ***H01C 7/10*** | (2006.01) |

(52) U.S. Cl.
CPC ..... *H01C 7/12* (2013.01); *H01C 7/10* (2013.01); *H01C 7/18* (2013.01)

(58) Field of Classification Search
CPC ..... H01C 7/12; H01C 7/18; H01C 7/10
See application file for complete search history.

(56) References Cited

U.S. PATENT DOCUMENTS

| | | | |
|---|---|---|---|
| 5,050,032 | A | 9/1991 | Thevenet et al. |
| 5,608,597 | A | 3/1997 | Holmstroem et al. |
| 5,936,826 | A | 8/1999 | Schmidt |
| 7,522,399 | B2 | 4/2009 | Siljeholm et al. |
| 8,305,184 | B2 | 11/2012 | Klaube et al. |
| 8,531,812 | B2 | 9/2013 | Barenthin et al. |
| 2013/0222964 | A1 | 8/2013 | Pippert et al. |
| 2014/0133060 | A1 | 5/2014 | Gottschalk et al. |

FOREIGN PATENT DOCUMENTS

| | | | |
|---|---|---|---|
| DE | 102008057232 | A1 | 5/2010 |
| DE | 102010043655 | A1 | 5/2012 |
| EP | 0397163 | A1 | 11/1990 |
| EP | 0683496 | A1 | 11/1995 |
| WO | 2004097858 | A1 | 11/2004 |
| WO | 2009050011 | A1 | 4/2009 |
| WO | 2013000732 | A1 | 1/2013 |

*Primary Examiner* — Zeev V Kitov
(74) *Attorney, Agent, or Firm* — Laurence Greenberg; Werner Stemer; Ralph Locher

(57) ABSTRACT

A surge arrester has several tensioning elements which brace the discharge column in the axial direction. One or more loop arrangements radially surround the tensioning elements. One loop arrangement has a plurality of loops. Each loop of the plurality of loops surrounds only some, but not all, of the tensioning elements.

6 Claims, 2 Drawing Sheets

SURGE ARRESTER COMPRISING TRACTION ELEMENTS MAINTAINED BY LOOPS

BACKGROUND OF THE INVENTION

Field of the Invention

The invention relates to a surge arrester comprising tensioning elements held by loops. The tensioning elements brace an arrester column consisting of varistor elements in the axial direction, and including one or more loop arrangements. Each loop arrangement loops radially around the tensioning elements.

Surge arresters are protective systems for power supply systems which, in the event of surges occurring, discharge surges occurring as a result of a lightning strike or malfunctions of other subsystems to ground and thus protect other component parts of the power supply system.

Such a surge arrester consists of a cylindrical arrester column, which is usually formed as a stack from individual, likewise cylindrical varistor elements. Varistor elements are characterized by a voltage-dependent resistance. At low voltages, said varistor elements act as insulators. Above a certain threshold voltage, which is material-dependent, they demonstrate good conductivity. Often, varistor elements are produced from metal oxides such as zinc oxide. The arrester column is delimited at both of its ends by end fittings, which produce the electrical contact to the power supply system and to ground. In order to ensure good electrical contact even under mechanical loading, the varistor elements need to be held together under pressure. This can take place by virtue of tensioning elements, for example cables or rods, preferably consisting of glass-fiber-reinforced plastic, being clamped into the end fittings under tension. The tensioning elements in this case surround the arrester column and thus form a cage around said arrester column. In order to provide protection against environmental effects, such surge arresters are often surrounded by a housing consisting of an insulating material such as, for example, silicone. The production of this housing can take place by means of casting or injection molding.

In the event of a fault, i.e. in the event of an overload of the surge arrester, the varistor elements can expand in the manner of an explosion. The cage formed from the tensioning elements is intended to still keep the arrester column together and to prevent fragments of the varistor elements from being slung out.

A problem with such surge arresters consists in preventing the tensioning elements from being destroyed by the explosion energy occurring in such a fault case or the cage formed from said tensioning elements being deformed so that fragments of the varistor elements can emerge.

In WO 2009/050011 A1, the cage consisting of tensioning elements is held together by metallic supporting plates inserted into the varistor column. The supporting plates have a greater diameter than the varistor column, for this purpose, and have holes in the part protruding out of the varistor column, through which holes the tensioning elements are passed. The protruding metallic parts of the supporting plates can result in flashovers, however, and the tensioning elements can shear away easily at the edges of the holes through which they are passed in the case of radial forces occurring.

EP 0 683 496 A1 discloses a surge arrester in which a banding guided around the arrester column is wound around the tensioning elements. The tensioning elements can in this case be spread apart towards one another in the event of a fault, however. If such a banding is destroyed, the tensioning elements are no longer held together at least at this point.

In DE 10 2010 043 655 A1, the tensioning elements are surrounded by a collar, which has radial protuberances for the tensioning elements. If, in the event of a fault, such a collar is expanded or destroyed, the cage formed from the tensioning elements loses its cohesion at this point.

BRIEF SUMMARY OF THE INVENTION

The object of the present invention consists in specifying a surge arrester whose cage has an improved level of cohesion in the event of a fault.

The object is achieved by a surge arrester comprising a plurality of tensioning elements bracing an arrester column consisting of varistor elements in the axial direction, and comprising one or more loop arrangements, wherein each loop arrangement loops radially around the tensioning elements. In this case, a loop arrangement has a plurality of loops, wherein the loops each loop around only some of the tensioning elements. Thus, for example, a loop arrangement could consist of two loops, of which each loops around two tensioning elements of a cage consisting of four tensioning elements. For example, in this case a loop which is laid around the arrester column could loop around every second tensioning element externally and pass the tensioning elements positioned therebetween internally, i.e. extend along between the tensioning element and the arrester column. A further loop, which is offset parallel to the first in the axial direction, would then loop around the latter half of the tensioning elements externally and pass the tensioning elements which were looped around externally by the first loop internally. If one of the loops should be destroyed, the loops that are still intact continue to hold together at least part of the cage. Depending on the axial height of the surge arrester, such loop arrangements can be fitted only once, for example in the center of the arrester column, or a plurality of these loop arrangements can be distributed over the axial height of the surge arrester.

In an advantageous configuration of the invention, a guide element is inserted into the arrester column at the axial height of a loop arrangement. The guide element has guide grooves, in which the loops are guided in direct connection between the tensioning elements around which said loops are looped. Since the loops thus run in the direction of the greatest forces in the event of a fault, they can absorb the highest possible tensile loading. In addition, the tensioning elements are thus fixed not only in the radial direction, but also in the tangential direction, i.e. perpendicular to the axial and radial direction. Owing to the fact that the loops extend radially through the arrester column, a plurality of loops can be arranged in a radial plane without crossing over one another.

In a particularly preferred embodiment of the invention, the surge arrester has an even number of tensioning elements, and the loops of the loop arrangement each loop around two opposite tensioning elements. Owing to this arrangement, a particularly high number of loops and therefore a particularly high degree of safety in the event of a fault is ensured since, in the case of destruction of one loop, only two tensioning elements are affected. The cage consisting of the remaining tensioning elements will continue to be held together by the loops that are still intact.

In a further advantageous configuration of the invention, the guide element has guide grooves in an upper and a lower covering surface. The guide grooves in one covering surface in this case extend perpendicular to those in the other covering surface. Thus, loops can be arranged crosswise in a guide element in order to absorb forces from all possible directions.

In addition, it is preferred for the loops to be manufactured from a glass-fiber-reinforced plastic. Such loops have particularly good tensile strength.

Furthermore, it is preferred if the guide element is manufactured from an electrically conductive material, in particular from a metal. Thus, the guide element at the same time acts as electrical connection between the varistor elements.

BRIEF DESCRIPTION OF THE SEVERAL VIEWS OF THE DRAWING

The invention will be explained in more detail below with reference to the drawings, in which.

DESCRIPTION OF THE INVENTION

Mutually corresponding parts have been provided with the same reference symbols in all of the figures.

Figure 1:
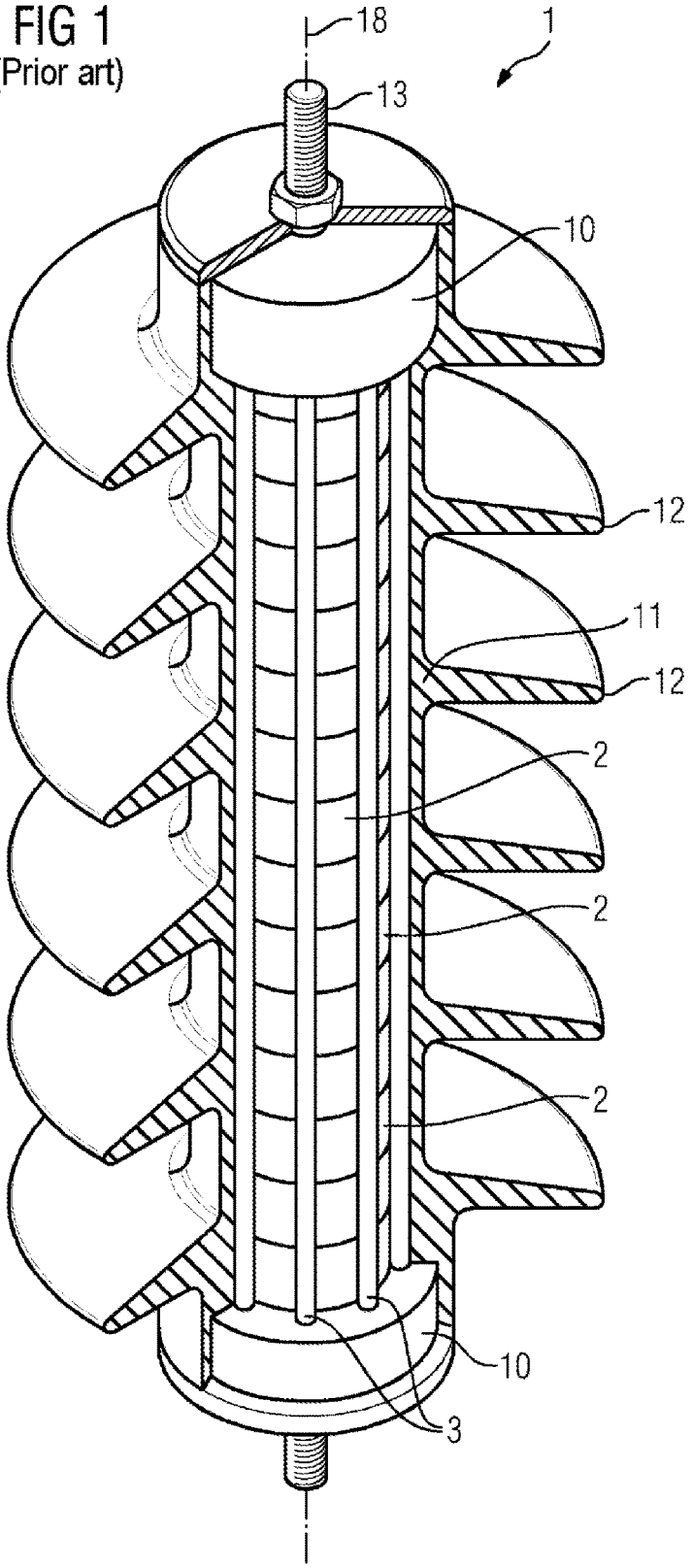
FIG 1 (Prior art)
FIG. 1 shows a surge arrester from the prior art in a sectional illustration.

A surge arrester 1 in accordance with the prior art is shown in FIG. 1. It consists of a cylindrical arrester column, which is usually formed as a stack from individual, likewise cylindrical varistor elements 2. The longitudinal axis 18 of the arrester column defines an axial direction; directions perpendicular to this longitudinal axis 18 are radial directions. The arrester column is delimited at both of its ends by end fittings 10, which produce the electrical contact to the power supply system and to ground, for example by means of a connection bolt 13.

In order to ensure good electrical contact even under mechanical loading, the varistor elements 2 need to be held together under pressure. This can take place by virtue of tensioning elements 3, for example cables or rods, preferably consisting of glass-fiber-reinforced plastic, being clamped into the end fittings 10 under tension. The tensioning elements 3 in this case surround the arrester column and thus form a cage around said arrester column. In order to protect against environmental effects, such surge arresters are surrounded by a housing 11 consisting of an insulating material such as, for example, silicone. The production of this housing 11 can take place by casting or injection molding. In addition, shields 12 for extending the leakage path can be provided on the housing 11.

Figure 2:
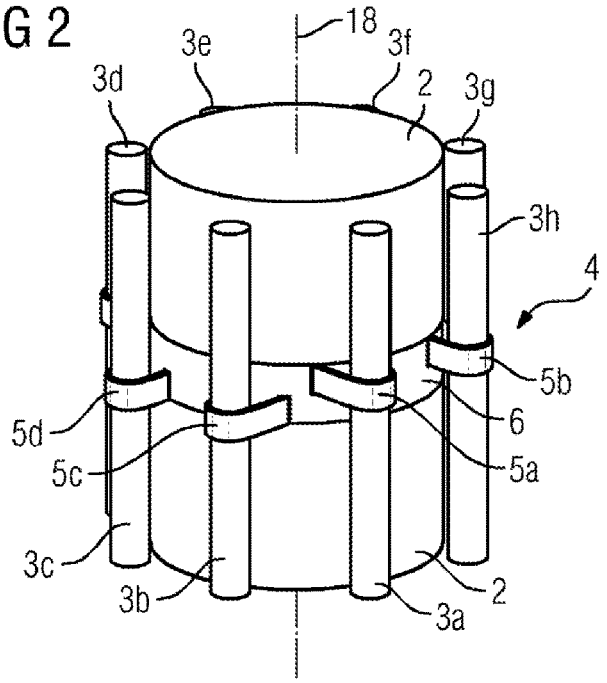
FIG. 2 shows a detail of a surge arrester according to the invention in a perspective illustration.
Figure 3:
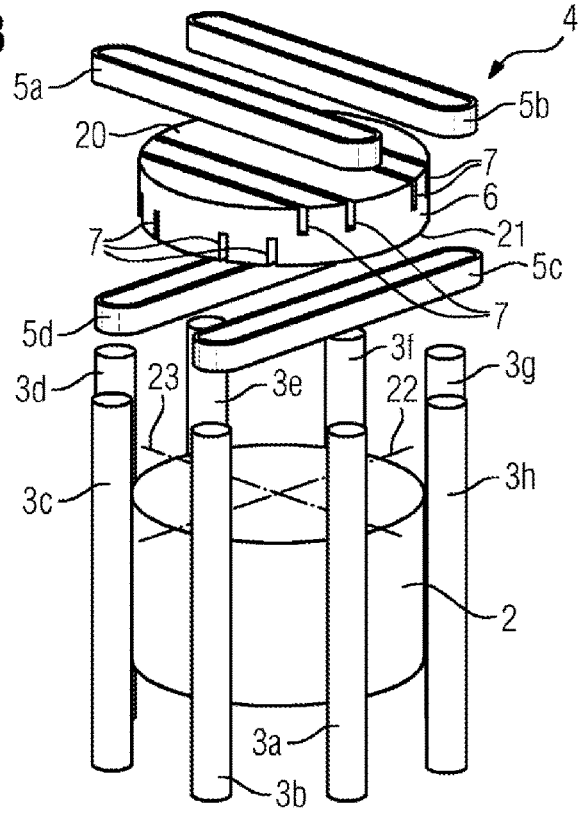
FIG. 3 shows an exploded illustration of a detail of a surge arrester according to the invention.

FIGS. 2 and 3 show part of a surge arrester according to the invention, which is a development of the known surge arrester 1 shown in FIG. 1 and also has the individual parts thereof. An arrester column, of which only two varistor elements 2 are shown here, extends along the longitudinal axis 18. The arrester column is surrounded by a cage consisting of eight tensioning elements 3*a* to 3*h*, which have an identical configuration and only differ in terms of their radial position. Insofar as the different position is inconsequential, the reference sign 3 is used for all tensioning elements. The guide element 6 is inserted into the arrester column between two varistor elements 2. This guide element 6 is in the form of a flat cylinder. The upper covering surface 20 and the lower covering surface 21 each have four parallel guide grooves 7. The guide grooves 7 in the upper covering surface 20 and the guide grooves in the lower covering surface 21 in this case extend perpendicular to one another. The thickness of the guide element 6 and the depth of the guide grooves 7 are matched to one another in this case in such a way that the guide grooves 7 do not cross over one another in one plane.

A loop arrangement 4 holds the cage consisting of tensioning elements 3 together. The loop arrangement 4 consists of four individual loops 5*a* to 5*d*, which only differ from one another in terms of their position. Insofar as the position does not play a role, the reference symbol 5 is also used for all loops. Each loop 5 loops around two tensioning elements 3, which are opposite one another based on a plane of symmetry having the longitudinal axis 18, indicated by the line 22 or 23. Thus, the loop 5*a* loops around the tensioning elements 3*a* and 3*d*, which are opposite one another based on the imaginary line 22. A second loop 5*b*, which extends parallel to this loop 5*a*, loops around the tensioning elements 3*h* and 3*e*. The loops 5*a* and 5*b* in this case lie in the same radial plane. Two further loops 5*c* and 5*d*, which loop around the tensioning elements 3*b* and 3*g* and 3*c* and 3*f*, respectively, lie in a plane parallel to this radial plane. The loops 5 extend in direct connection between the tensioning elements 3 around which they loop. The guide grooves 7 in the guide element 6 are thus matched to the loops 5 such that a loop 5 runs in two parallel guide grooves 7. The two loops 5*a* and 5*b* in this case extend in four guide grooves 7 in the upper covering surface 20 of the guide element 6, and the two loops 5*d* and 5*c* extend in four guide grooves 7 in the lower covering surface 21. The depth of the guide grooves 7 is in this case dimensioned such that the loops 7 can be pushed completely into the guide groove 7 in terms of their width.

However, it is also conceivable for the two parallel sides of the loops 5 to extend, laid against one another, in a guide groove 7. The guide grooves 7 should then be extended in the form of a V at the openings emerging into the lateral surface of the guide element 6 in order to avoid a sharp bend in the loops 5.

It is of course possible for the loop arrangement 4 shown to also be arranged at a plurality of points along the longitudinal axis 18 of the surge arrester 1.

The invention claimed is:

1. A surge arrester, comprising:

an arrester column formed of a plurality of varistor elements;

a plurality of tensioning elements bracing said arrester column in an axial direction;

one or more loop arrangements each looping radially around said tensioning elements, each said loop arrangement having a plurality of loops and each loop of said plurality of loops looping around only some of said tensioning elements.

2. The surge arrester according to claim 1, which comprises a guide element inserted into said arrester column at an axial height of a loop arrangement, said guide element having guide grooves formed therein, and wherein said loops are guided in said guide grooves in direct connection between the respective said tensioning elements around which said loops are looped.

3. The surge arrester according to claim 1, wherein said plurality of tensioning elements are an even number of tensioning elements, and each of said loops loops around exactly two mutually opposite tensioning elements.

4. The surge arrester according to claim 2, wherein said guide element has an upper covering surface and a lower covering surface each formed with said guide grooves, wherein said guide grooves in said upper covering surface extend at right angles to said guide grooves in said lower covering surface.

5. The surge arrester according to claim 1, wherein said loops are formed of a glass-fiber-reinforced plastic.

6. The surge arrester according to claim 1, wherein said guide element is formed of an electrically conductive material.

* * * * *